US005671841A

United States Patent [19]

Glasson

[11] Patent Number: 5,671,841

[45] Date of Patent: Sep. 30, 1997

[54] METHOD AND APPARATUS FOR SWITCHING MECHANISM

[75] Inventor: Richard Owen Glasson, East Hanover, N.J.

[73] Assignee: Calculagraph Co., East Hanover, N.J.

[21] Appl. No.: 667,299

[22] Filed: Jun. 20, 1996

Related U.S. Application Data

[63] Continuation of Ser. No. 514,595, Aug. 14, 1995, abandoned.

[51] Int. Cl.[6] ..... H01H 5/18

[52] U.S. Cl. ..... 200/406; 200/409; 200/520; 200/535; 200/307.2; 200/341

[58] Field of Search ..... 200/406, 409, 200/408, 520, 521, 532, 535, 329, 302.2, 407, DIG. 29, 267, 302.1, 341

[56] References Cited

U.S. PATENT DOCUMENTS

| | | | |
|---|---|---|---|
| 1,872,205 | 8/1932 | Winger . | |
| 2,077,362 | 4/1937 | Holm | 200/67 |
| 2,345,240 | 3/1944 | Cox, Jr. | 200/67 |
| 2,434,984 | 1/1948 | Bolesky et al. | 200/138 |
| 2,516,236 | 7/1950 | Moorhead et al. | 200/67 |
| 2,704,312 | 3/1955 | Mang | 200/113 |
| 2,839,638 | 6/1958 | Epstein | 200/138 |
| 2,958,751 | 11/1960 | Camp | 200/538 |
| 3,987,264 | 10/1976 | Seidler | 200/267 |
| 3,996,429 | 12/1976 | Chu et al. | 200/406 |
| 3,997,745 | 12/1976 | Marquardt et al. | 200/409 |
| 4,197,437 | 4/1980 | Michalski | 200/67 |
| 4,234,769 | 11/1980 | Brandt et al. | 200/67 |
| 4,417,113 | 11/1983 | Saito et al. | 200/302.2 |
| 4,698,466 | 10/1987 | Beck et al. | 200/302.2 |
| 4,929,808 | 5/1990 | Roeser et al. | 200/467 |
| 4,931,605 | 6/1990 | Zoller | 200/406 |
| 5,055,643 | 10/1991 | Pardini et al. | 200/302.2 |
| 5,079,394 | 1/1992 | Toima et al. | 200/406 |
| 5,190,150 | 3/1993 | Laue et al. | 200/520 |

FOREIGN PATENT DOCUMENTS

| | | |
|---|---|---|
| 2727763 | 1/1979 | Germany . |
| 538437 | 10/1956 | Italy . |
| 450521 | 4/1968 | Switzerland . |

OTHER PUBLICATIONS

Ferdinand P. Beer, E. Russell Johnston, Jr., "Mechanics of Materials", 1981, pp. 528–529, published by McGraw–Hill, Inc. in U.S.A.

(List continued on next page.)

*Primary Examiner*—David J. Walczak
*Attorney, Agent, or Firm*—Walter J. Tencza, Jr.

[57] ABSTRACT

A switching mechanism comprising a housing, a spring, first and second movable contacts mechanically attached to the spring, first and second substantially fixed contacts attached to the housing, and an actuator is provided. The spring comprises first and second edges substantially fixed to the housing. In a rest position the first and second movable contacts do not electrically contact the first and second substantially fixed contacts, respectively. The actuator centrally actuates the spring to cause the first and second movable contacts to move in the same direction as the central portion of the spring and to electrically contact the first and second substantially fixed contacts.

The spring is preferably a snap spring shaped in the form of a cross comprising a column member and first and second protruding wings. The first and second movable contacts are preferably mechanically and electrically connected to the first and second protruding wings respectively.

The actuator preferably includes a ball, a substantially cylindrical portion having a first outer diameter, and a seal having a second outer diameter. The seal is preferably an O-ring seal which is designed to fit tightly around the substantially cylindrical device and tightly inside the housing.

37 Claims, 8 Drawing Sheets

OTHER PUBLICATIONS

Part Sheet for Otto Controls switch, Otto Controls, 2 East Main Street, Carpentersville, IL. 60110. No date.

Part sheet for Honeywell switch, "Other Industrial Solutions–Standard Basic Switches", Honeywell, Micro switch Sensing and Control. No date.

Design Guide, Pollak Precision Ball Switches, and two accompanying figures No date.

METHOD AND APPARATUS FOR SWITCHING MECHANISM

This is a continuation of Applicant's earlier filed application Ser. No. 08/514,595, filed on Aug. 14, 1995, now abandon.

FIELD OF THE INVENTION

The present invention relates to switching mechanisms and more particularly to switching mechanisms for use in ball actuated switches.

BACKGROUND OF THE INVENTION

Switching mechanisms using spring-like materials which "snap" or quickly change from one state to another have been developed in various forms. However many of these switching mechanisms include numerous moving parts and are difficult to employ, particularly in existing ball actuation switches.

Winger, U.S. Pat. No. 1,872,205, discloses a snap action switch in which a stem 24 is pushed upwardly to cause contact carrying extremities to move downwardly and disconnect. (p. 2, col. 1, lns. 30–39.) Moorhead et al., U.S. Pat. No. 2,516,236 discloses a disk and contacts, wherein when the disk is pushed in one direction the contacts go in the other direction. Epstein U.S. Pat. No. 2,839,638, and Bolesky, et. al., U.S. Pat. No. 2,434,984 disclose a thermally responsive switch which is reset by pressure on a periphery of a disk structure. Pressure on the periphery of a disk to activate or deactivate a switch is also shown in Mang, U.S. Pat. No. 2,704,312 and Cox U.S. Pat. No. 2,345,240.

Michalski, U.S. Pat. No. 4,197,437 discloses a ball actuated roof shaped switch. FIG. 15. In one embodiment the roof element is pushed downwards by a ball 26 and the contacts 20 and 19 are connected, while the contact reeds 27 come upwards, upon actuation.

Holm, U.S. Pat. No. 2,077,362 discloses a snap spring 16 which is actuated by a pin 15. FIG. 1. The snap spring 16 has attached to it contacts 18 which connect with contacts 19 when the spring comes forward. The contacts 18 are attached by a separate contact carrier and the snap spring 16 is not used as a current carrying device. FIG. 1. A separate spring 21 is used to provide resnap force after the actuation force is removed.

SUMMARY OF THE INVENTION

The present invention in one form comprises an improved snap action switching mechanism which includes a cross shaped spring. The switching mechanism further comprises a mechanism housing, a first movable contact mechanically attached to the spring, a first substantially fixed contact attached to the mechanism housing, and an actuator. The spring comprises first edge and second edges, which are substantially opposite one another, and a substantially central portion. Each edge of the spring is substantially fixed to the mechanism housing so that in a rest position the first movable contact does not electrically contact the first substantially fixed contact. The actuator provides an actuation force to force the substantially central portion of the spring and the first movable contact towards a first direction and to cause the first movable contact to electrically contact the first substantially fixed contact.

In one form of the invention first and second movable contacts mechanically connected to the spring, and first and second substantially fixed contacts attached to the mechanism housing are provided. The actuation force causes the second movable contact to move in the same first direction, and to electrically contact the second substantially fixed contact. A return force can be provided to the spring by one or both of the substantially fixed contacts, through the movable contacts, to cause the spring to return to its rest position after the actuation force is removed.

The spring is preferably a conductive device and the first and the second movable contacts are preferably electrically connected to the spring. However, a separate current carrying device can be attached to the spring to allow current to flow from the first substantially fixed contact to the first movable contact through the separate current carrying device to the second movable contact and finally to the second substantially fixed contact.

The spring is preferably a snap spring shaped in the form of a cross comprising a column member and first and second protruding wings. The column member can be substantially rectangular in shape, comprising a shorter first pair of opposing sides which act as the first and second edges of the spring, and a longer second pair of opposing sides. The first and second movable contacts are mechanically connected to the first and second protruding wings, respectively. Each protruding wing can be attached substantially centrally to one of the second pair of opposing sides of the column member of the spring.

The mechanism housing preferably comprises a cup shaped cylindrical portion having an inner surface area with an inner diameter, and a closed bottom surface. The inner surface area comprises a first recess and a substantially opposing second recess. The column member preferably has a length, from its first edge to its second edge, which is less than the inner diameter of the mechanism housing so that the column member needs to be bent or flexed lie to lengthwise with its first and second edges placed in the first and second recesses, respectively of the mechanism housing. In accordance with the present invention the column member is preferably flexed in a bowed rest position, and the first and second edges of the column member are placed in the first and second recesses respectively of the mechanism housing. When the actuation force is provided the column member changes its shape to a bowed actuation position which is opposite that of the bowed rest position.

The actuator of the present invention preferably comprises a ball. A member can be provided for exerting a downward force on the ball to cause the ball to provide an actuation force to the spring. The member may slide over the ball or push directly downward to provide the downward force.

In accordance with another aspect of the present invention a switching mechanism is provided comprising a mechanism housing, an actuator housing, a seal, and a switching device. The mechanism housing comprises a cylindrical portion having an inner diameter. The actuator housing is preferably substantially cylindrical having a first outer diameter. The seal is preferably an O-ring seal having a second outer diameter. The O-ring seal is designed to fit tightly around the actuator housing, preferably within an indented region of the actuator housing. The assembled actuator housing and O-ring seal fit sufficiently snugly inside the cylindrical portion of the mechanism housing so that the O-rings seal rubs against the inner surface of the cylindrical portion when the assembled actuator housing and the O-ring seal are slid up and down inside the cylindrical portion. The switching device is responsive to the sliding up and down of the assembled actuator housing and the O-ring seal.

The present invention provides a switching mechanism which is particularly suitable for implementation in existing ball actuation switches. In the two movable contact and two substantially fixed contact form, the present invention provides a double break switch that can carry a high electrical load. In its cross shaped form, the switching mechanism can satisfy the tight dimensional constraints needed in order to place it into existing ball actuated switches. The cross shaped spring is also inexpensive to manufacture. In its snap action form the present invention provides a quick acting switching mechanism. The providing of resnap force by the substantially fixed contacts through the movable contacts, eliminates the need for further mechanical parts such as other springs.

DETAILED DESCRIPTION OF THE DRAWINGS

Figure 1A:
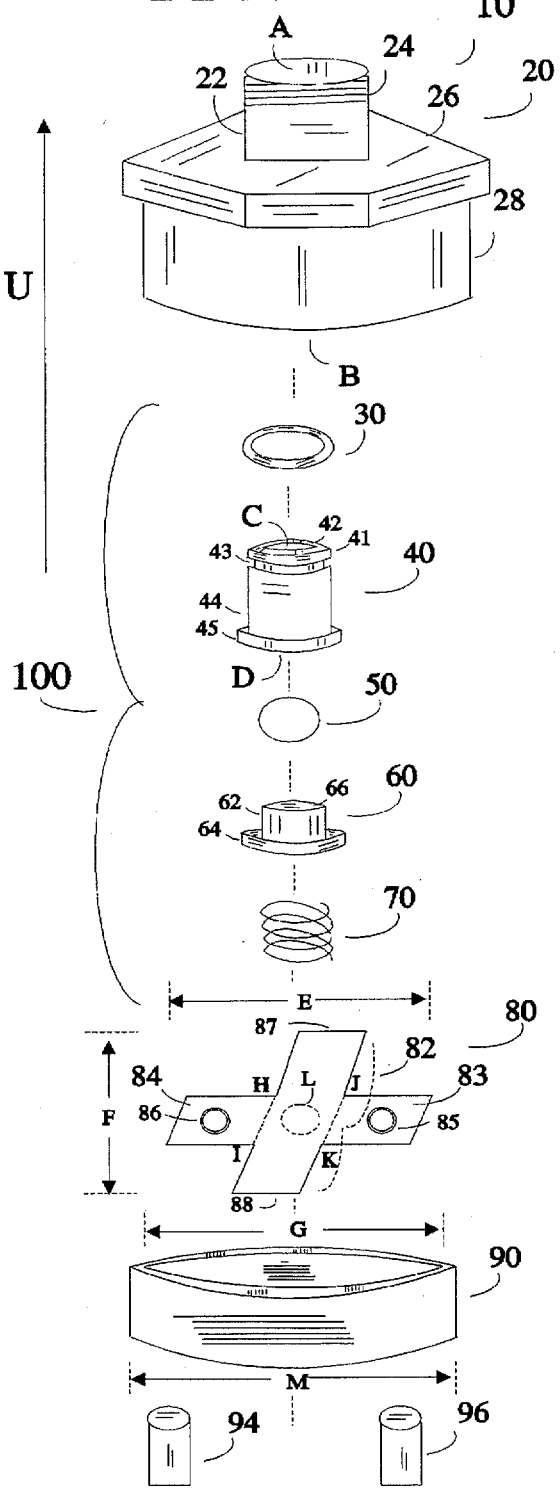
FIG. 1A illustrates an exploded view of a ball actuation switching mechanism in accordance with the present invention.

FIG. 1A shows an exploded view of a ball actuation switching mechanism 10. The ball actuation switching mechanism 10 includes top mechanism housing 20, actuator 100, spring 80, bottom mechanism housing 90, and contacts 94 and 96. The actuator 100 includes O-ring seal 30, actuator housing 40, ball 50, actuator cap 60 and spring 70.

The top mechanism housing 20 is preferably metal and is comprised of a top cylinder portion 22, a hexagonal portion 26, and a bottom cylinder portion 28. The top cylinder portion 22 is a hollow cylinder having a plurality of grooves 24 on its outside near its top. The grooves 24 are used to connect the ball actuation switching mechanism 10 to an application specific mounting hole. The hexagonal portion 26 has a hexagonal periphery as shown, but an inner chamber which is cylindrical. The hexagonal shape of portion 26 is used to install the switching mechanism 10 into various environments such as for example automobile transmission, other types of transmission, and rotating equipment. The hexagonal portion should preferably fit a 0.875 inch socket wrench. As shown in the bottom view of the top mechanism housing 20 in FIG. 1D, the hexagonal portion 26 and the cylinder portion 28 have an inner diameter of "O". The top cylinder portion 22 has an inner diameter of "N" which is less than "O".

The O-ring seal 30 is preferably made of Buna-N Rubber, but can also be made of other natural or synthetic polymers. The O-ring seal 30 is preferably a tubular shaped elastic material. The actuator housing 40 is molded into a configuration comprising a top portion 41, an indented portion a body portion 44 and a bottom portion 45. The top portion 41 is a hollow cylinder having a constant inner diameter, with the exception of a lip 42 at the top of the top portion 41. The lip 42 has an inner diameter less than the rest of the top portion 41, and portions 44 and 45. The O-ring seal 30 preferably has an inner diameter, when it is not being stretched, which is less than the outer diameter of the top portion 41, so that the O-ring seal 30 needs to be stretched to fit over the top portion The indented portion 43 is a hollow cylinder which has an outer diameter less than that of the top portion 41, but has an inner diameter equal to that of the majority of top portion 41. The body portion 44 is a hollow cylinder which has an outer and an inner diameter equal to that of the majority of the top portion 41, excluding the lip 42. The bottom portion 45 is a hollow cylinder which has an outer diameter greater than that of the body portion 44 and an inner diameter equal to that of the body portion 44.

Figure 1B:
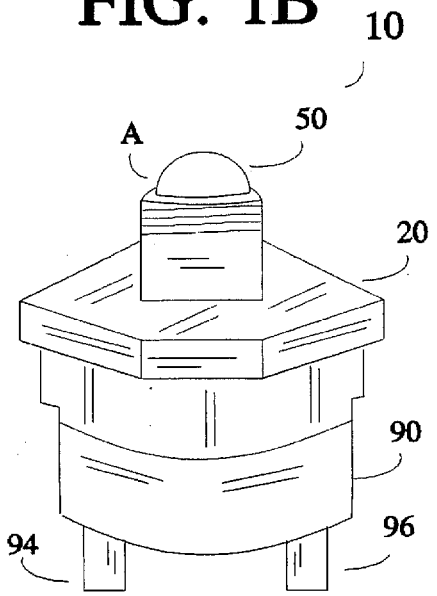
FIG. 1B illustrates the ball actuation switching mechanism of FIG. 1A in assembled form.
Figure 1C:
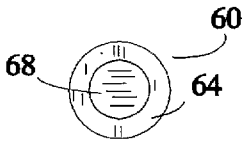
FIG. 1C illustrates a bottom view of an actuator cap for use in the switching mechanism of FIG. 1A.
Figure 1D:
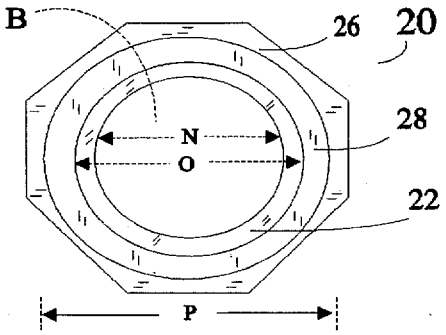
FIG. 1D shows a bottom view of the top mechanism housing for use in the switching mechanism of FIG. 1A.

The actuator housing 40 and the actuator cap 60 are preferably made of plastic. The bottom portion 45 of the actuator housing 40 has an outer diameter which is less than the inner diameter of the bottom cylinder portion 28 of the top mechanism housing 20. This allows the actuator housing 40 to be inserted into the hollow opening B, at the bottom of the top mechanism housing 20, as shown in FIGS. 1A and 1D. However, the outer diameter of the bottom portion 45 is greater than the inner diameter of the top cylinder portion 22, preventing the bottom portion 45 from entering the top cylinder portion 22 of the housing 20.

The body portion 44 and the majority of top portion 41 have outer diameters which are slightly less than the inner diameter of the top cylinder portion 22 of the top mechanism housing 20, allowing the majority of the actuator housing 40 to be inserted into the top cylinder portion 22 of the housing 20.

The ball 50 is preferably a solid steel ball but may be any type of rolling ball. The actuator cap 60 is comprised of body portion 62 and bottom portion 64. The body portion 62 of the actuator cap 60 has an outer diameter which is slightly less than the inner diameters of the portions 41, 43, 44, and 45 of the actuator housing 40. The body portion 62 ends in a surface 66 which provides a resting place for the ball 50. The bottom portion 64 of actuator cap 60 has an outer diameter equal to the outer diameter of the bottom portion 45 of the actuator housing 40.

The wound spring 70 insures snap action regardless of speed of actuation.

The spring 80 is comprised of a column member 82, which has a length "F". The column member 82 has a substantially central portion indicated at "L". The spring 80 is also comprised of protruding wings 83 and 84 which are attached substantially central to the opposing sides of the column member 82. Dashed lines HI and JK are shown separating the column member 82 from the protruding wings 83 and 84, however these components may be made of the same material and may be connected in one smooth cross shape. Movable contacts 85 and 86 are attached to protruding wings 83 and 84, respectively. The movable contacts 85 and 86 are preferably made of silver cadmium oxide ($AgSnO_2$). Other materials may be preferable for the movable contacts 85 and 86 in cases where a special electrical loading is anticipated, i.e. inductive load versus lamp load. The spring 80 is preferably made of beryllium copper. Movable contacts 85 and 86 are preferably "cold headed" or "peened" and rivet shaped, as known in the art, and they may have a diameter of about 0.125 inches. The movable contacts 85 and 86 may be formed by inserting rod-like pieces of metal, such as silver cadmium oxide, into holes in the wings 83 and 84 and then squashing one or both sides of the rod-like material to form rivet-headed structures. This is shown further with reference to FIGS. 8A–8C. The overall shape of the spring 80 is that of a cross. The spring 80 is preferably a "snap" spring, which changes quickly from one bowed state to an opposite bowed state.

Bottom mechanism housing 90 is a cup shaped cylinder having a closed bottom surface, with the exception of two predrilled holes for contacts 94 and 96. The housing 90 is preferably plastic. Housing 90 has an inner diameter "G" which is less than the length "F" of the column member 82, but greater than the length "E" from the end of protruding wing 84 to the end of protruding wing 83. These dimensions allow the protruding wings 83 and 84 to move freely without touching the inner walls of the bottom mechanism housing 90. The outer diameter of the bottom mechanism housing 90 "M" is slightly less than the inner diameter "O", shown in FIG. 1D, of the bottom cylinder portion 28 and hexagonal portion 26 of the top mechanism housing 20. The bottom mechanism housing 90 includes two recesses for fitting first and second edges, 87 and 88, respectively, of the column member 82 into the housing 90, which will be described with reference to FIGS. 2A–2B and 3A–3B. In this embodiment the first and second edges of the column member 82 are the two shorter opposing sides, 87 and 88, of the rectangularly shaped column member 82.

The ball actuation switching mechanism 10 can be assembled in the following manner. The O-ring seal 30 is stretched over the top portion 41 of the actuator housing 40, until it fits snugly in the indented portion 43 of the actuator housing 40. Preferably, the thickness of the O-ring seal 30 is such that after it has been fit into the indented portion 43, its periphery has a larger outer diameter than the portions 41, 44, or 45. In addition, the outer diameter presented by the O-ring seal 30 fitted in the indented portion 43 is designed to provide a snug fit between the inner surface of the top cylinder portion 22 of the top mechanism housing 20 and the actuator housing 40. This means the outer diameter presented by the fitted O-ring seal 30 should be slightly more than the inner diameter "N" shown in FIG. 1D for the top cylinder portion 22 of the housing 20. These dimensions allow the assembled actuator housing 40 and the O-ring seal 30 to slide up and down inside the cylinder portion 22, but also to also cause the O-ring seal 30 to frictionally engage the inner surface of the top cylinder portion 22. In accordance with the present invention this allows the O-ring seal 30 to provide a tight seal to prevent moisture, dirt, debris, or preferably even water from accumulating and affecting the switching components inside top and bottom mechanism housing 20 and 90.

Although the remaining components can better be assembled by holding the components of FIG. 1A upside down, the description of the assembly will refer to assembly occurring in an upwards direction "U" as shown in FIG. 1A. With the O-ring seal 30 and actuator housing 40 assembled, the ball 50 can then be inserted through the bottom opening "D" of the actuator housing 40. The actuator cap 60 is inserted after the ball 50 and holds the ball 50 in place, with the ball 50 resting on its solid top surface 66. The actuator cap 60 is preferably sealed to the actuator housing 40 by cold forming the actuator housing 40. The diameter of the ball 50 is greater than the inner diameter of the lip 42 so that the ball 50 cannot pass through the top opening "C" of the actuator housing 40.

After the O-ring seal 30, actuator housing 40, ball 50, and actuator cap 60, have been assembled together, they are inserted into the bottom opening B of the housing 20. The assembled components 30, 40, 50, and 60 are pushed up into the top cylinder portion 22 so that the ball 50 sticks out of the opening "A" as shown in FIG. 1B. Because the outer diameter of the bottom portion 45 of the actuator housing 40 is larger than the inner diameter of the top cylinder 22 of the top mechanism housing 20, the components 30, 40, 50, and 60 are prevented from passing through the opening A.

The spring 70 can then be inserted into the bottom opening "B" of the bottom cylinder 28 of the top mechanism housing 20, so that one end of the spring 70 presses against the depressed inner surface 68 of the actuator cap 60. FIG. 1C shows a bottom view of the actuator cap 60 with its bottom portion 64 and its depressed inner surface 68. The spring 70 preferably has windings having a diameter slightly less than the diameter of the depressed inner surface 68 shown in FIG. 1C, so that one end of the spring 70 fits inside the depressed inner surface 68.

Figure 2A:
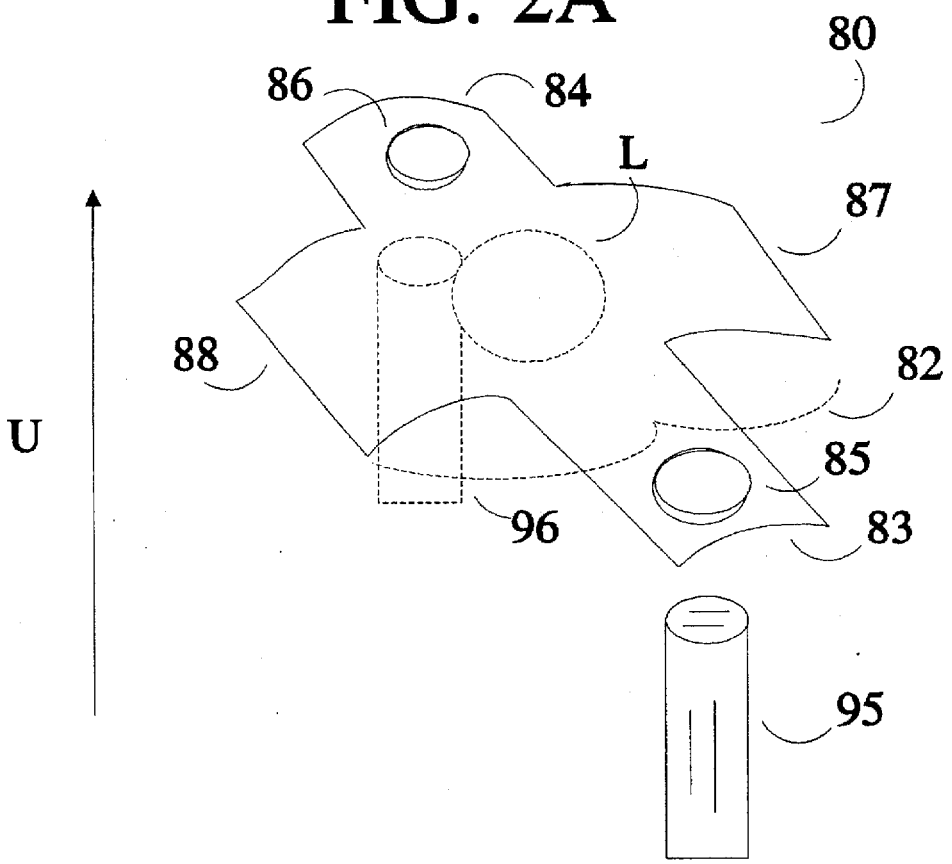
FIG. 2A is a perspective view of the spring of FIG. 1A in a bowed open state.
Figure 2B:
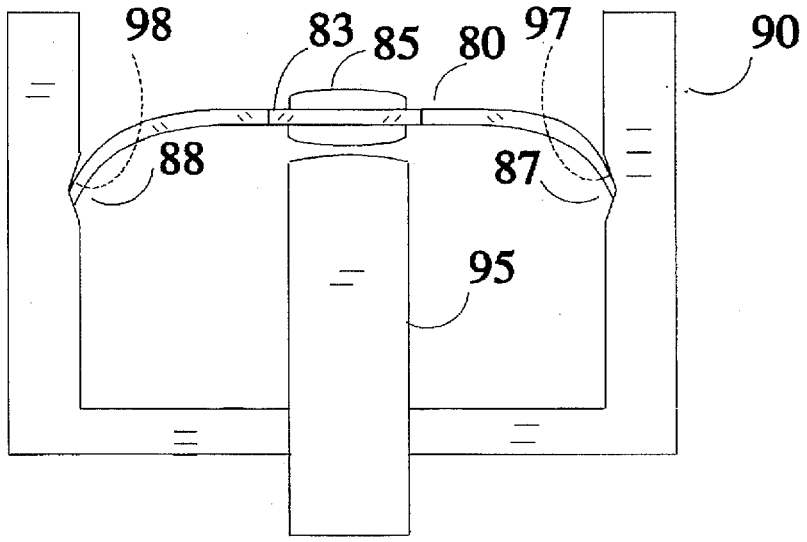
FIG. 2B is a cross sectional view of the spring of FIG. 1A, in the open state of FIG. 2A.
Figure 3A:
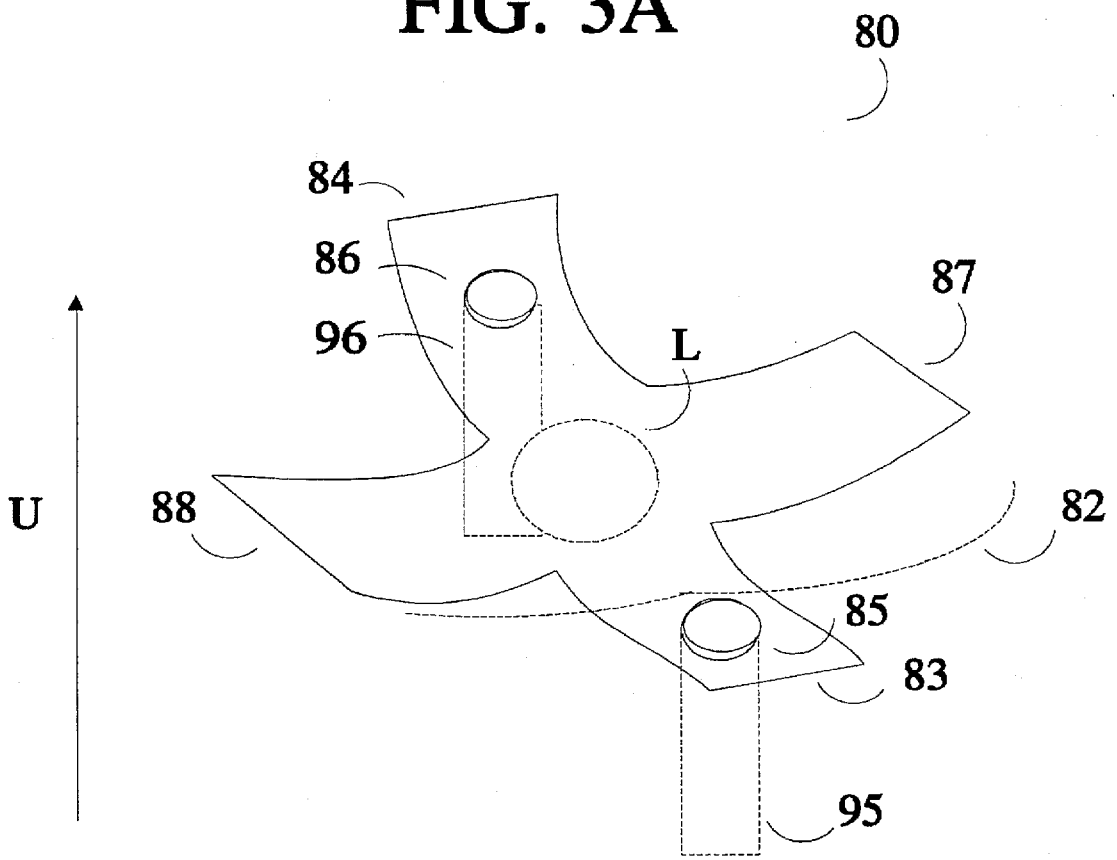
FIG. 3A is a perspective view of the spring of FIG. 1A in a bowed closed state.
Figure 3B:
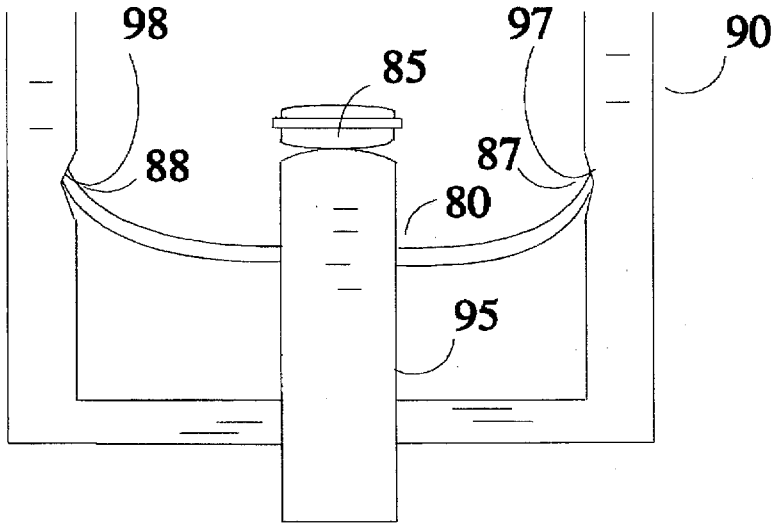
FIG. 3B is a cross sectional view of the spring of FIG. 1A, in the closed state of FIG. 3A.

The cross-shaped spring 80 is inserted into the housing 90, by flexing the column member 82 in a bowed upwards manner, toward the direction "U", as shown in FIG. 2A, and placing the first and second edges, 87 and 88, of the column member 82 into the first and second recesses 97 and 98 shown in FIGS. 2B and 3B and located inside the bottom mechanism housing 90. After the spring 80 has been placed in the bottom mechanism housing 90, the bottom mechanism housing 90 is then inserted into the bottom cylinder portion 28 of the housing 20. The outer diameter "M" of the bottom mechanism housing 90 is slightly less than the inner diameter "O" of the bottom cylinder portion 28 of the top mechanism housing 20, but greater than the inner diameter "N" of the top cylinder portion 22, shown in FIG. 1D, so that the housing 90 can fit inside the bottom cylinder portion 28 but not inside the top cylinder portion 22.

After the housing 90 has been inserted into the housing 20, it is preferred that the bottom cylinder portion 28 of the housing 20 be crimped, as shown in FIG. 1B, to hold the housing 90 and the housing 20 together, and consequently to keep the center portion "L" of the cross shaped spring 80 pressed against the other end of the spring 70.

The contacts 95 and 96 are preferably drilled through predrilled holes at the bottom of the housing 90. The contacts 95 and 96 are later sealed to the housing 90 with a type of epoxy to provide water proofing of the switching mechanism 10.

The operation of the spring 80 after the ball actuation switching mechanism 10 has been assembled will be described with reference to FIGS. 2A–2B and 3A–3B. FIGS. 2A and 2B show a view of the spring 80 in its bowed non-actuated open state. The column member 82 of the spring 80 is in a flexed bowed upwards state. The movable contacts 85 and 86 are not electrically connected to the fixed contacts 95 and 96, respectively.

FIGS. 3A and 3B show a view of the spring 80 in its actuated state. The column member 82 of the spring 80 is in a flexed or bowed downwards configuration. The movable contacts 85 and 86 are connected to the fixed contacts 95 and 96 respectively so that electrical connection is provided through both. The spring 80 is activated by applying a downwards force to the ball 50 shown in FIG. 1B. This forces the assembled components 30, 40, 50, and 60, in FIG. 1A downwards causing them to compress and force the spring 70 downwards. When the spring 70 is forced downwards and is compressed, it presses against the central portion "L" of the column member 82 and snaps the column member 82 of the snap spring 80 from its bowed upwards state shown in FIGS. 2A–2B to its bowed downwards state shown in FIGS. 3A–3B.

When the column member 82 is flexed downwards the first and second protruding wings 83 and 84 are also flexed downwards as a result of the movable contacts 85 and 86 pressing against the substantially fixed contacts 95 and 96. This flexing of the protruding wings 83 and 84 preferably provides a resnap force and causes the spring 80 to return to its open state of FIGS. 2A–2B when the actuation force has been removed.

Figure 4A:
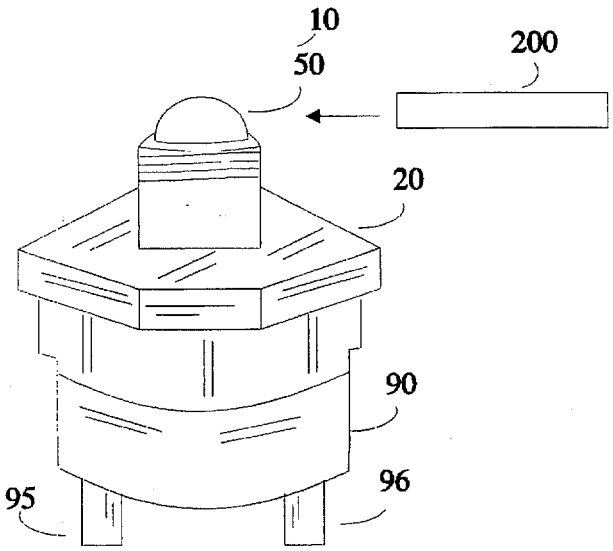
FIGS. 4A and 4B and FIGS. 4C and 4D show two different apparatus and methods of actuation of the switching mechanism of FIGS. 1A and 1B.
Figure 4B:
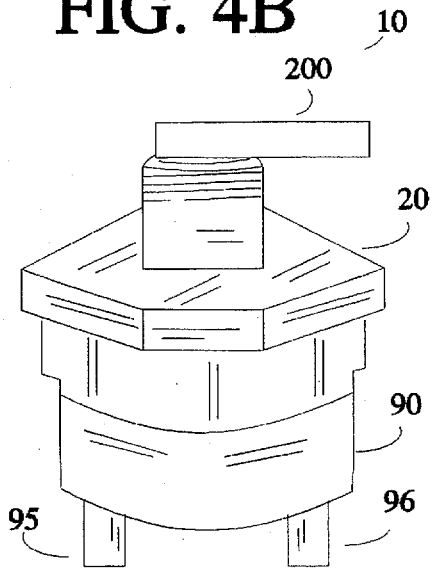
Figure 4C:
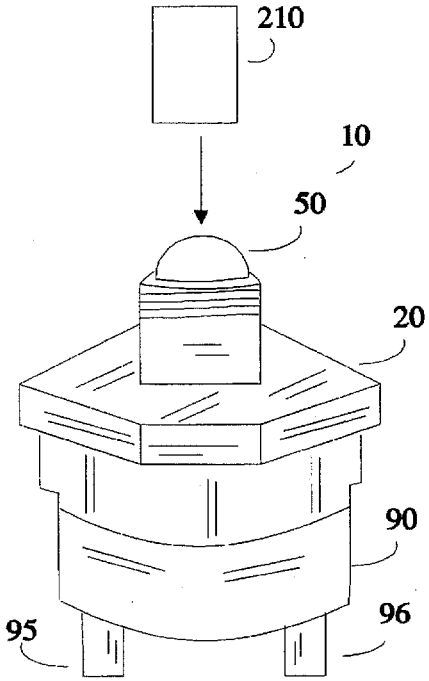
Figure 4D:
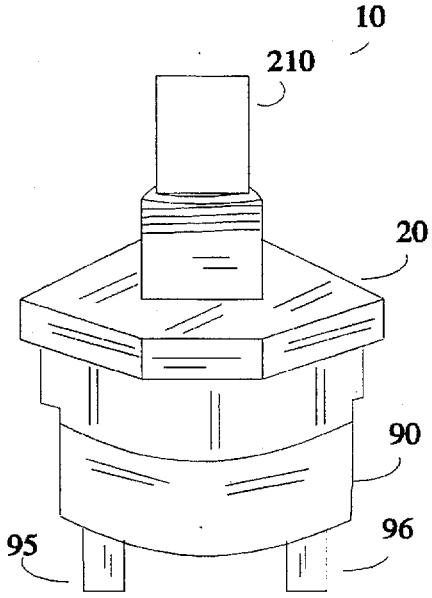
Figure 5A:
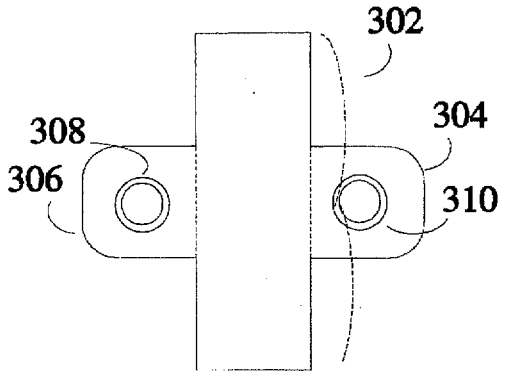
FIGS. 5A, 5B, 5C, and 5D illustrate alternative configurations for a cross shaped spring in accordance with the present invention
Figure 5B:
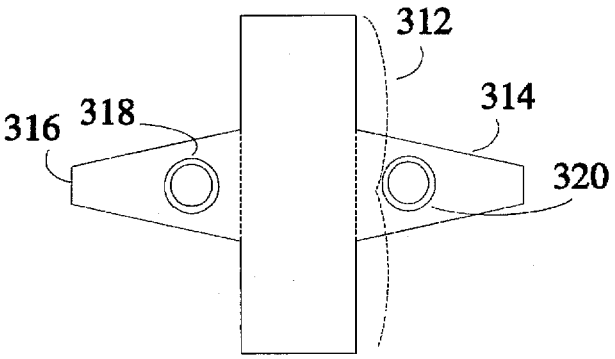
Figure 5C:
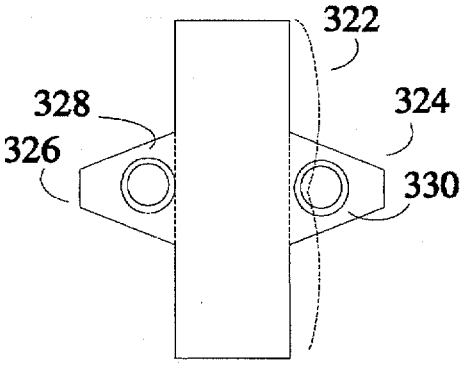
Figure 5D:
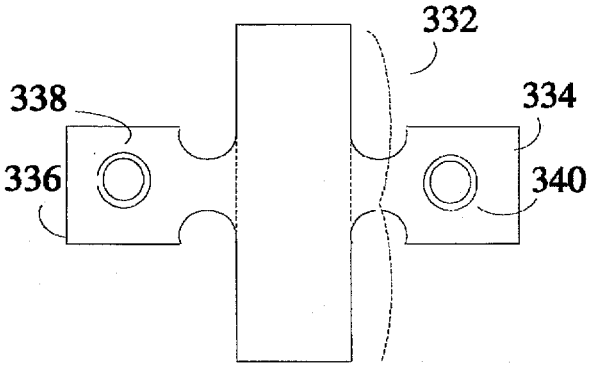

FIGS. 4A and 4B show two different apparatus and methods of actuation of the switching mechanism 10 of FIGS. 1A and 1B. In FIGS. 4A and 4B the switching mechanism 10 is actuated by a member 200 which slides over the ball 50 to exert a downward force. In FIG. 4B, the switching mechanism 10 is actuated by a member 210 which pushes directly downwards to exert a downward force on the ball 50.

FIGS. 5A, 5B, 5C, and 5D illustrate alternative configurations for a spring analogous to the spring 80 shown in FIG. 1A. Each spring includes a column member, first and second protruding wings, and two corresponding movable contacts. The column members shown are 302, 312, 322, and 332. The pairs of first and second protruding wings shown are 304 and 306, 314 and 316, 324 and 326, and 334 and 336. The corresponding contact pairs shown are 308 and 310, 318 and 320, 328 and 330, and 338 and 340. The alternatives shown are not intended to be limiting and other forms for a spring analogous to the spring 80 of FIG. 1A are contemplated by the present invention.

FIGS. 6A, 6B, 7A, and 7B illustrate an alternative embodiment of the present invention. In those figures a spring 480 is shown which provides a closed circuit in a bowed upwards state and preferably provides an open circuit in a bowed downwards state.

Figure 6A:
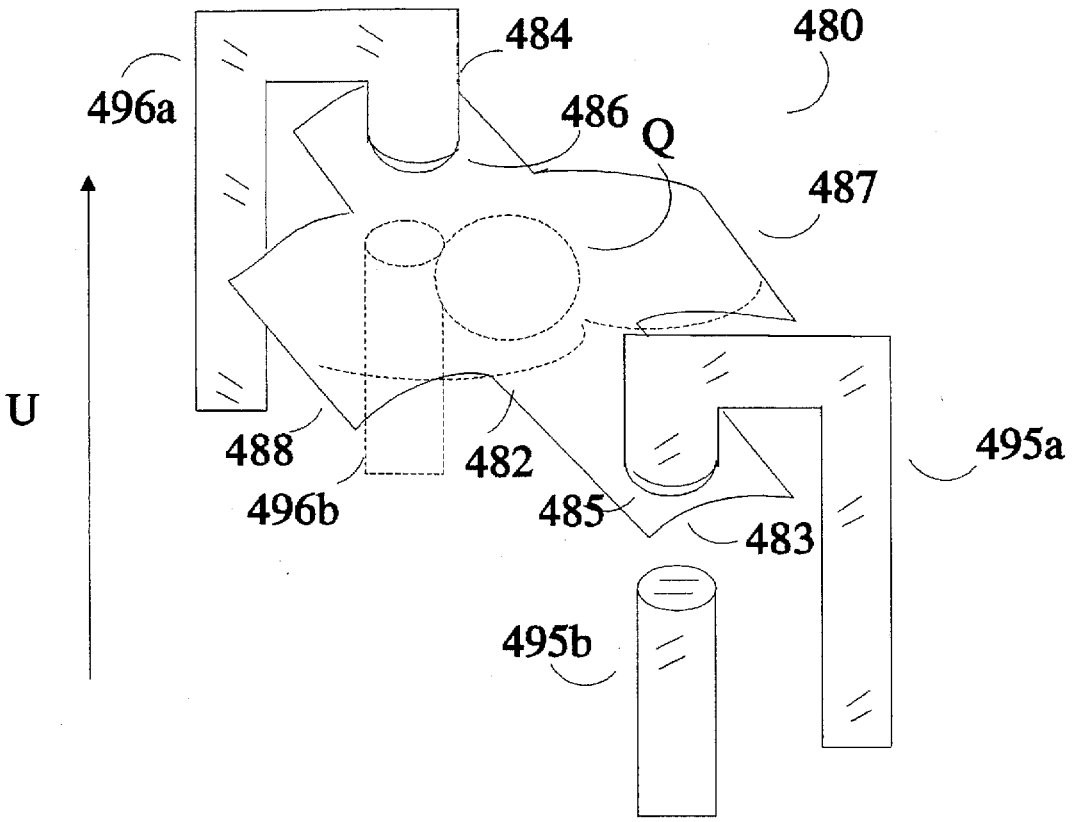
FIGS. 6A and 6B show perspective and cross sectional views of a spring which is closed when it is bowed upwards.
Figure 6B:
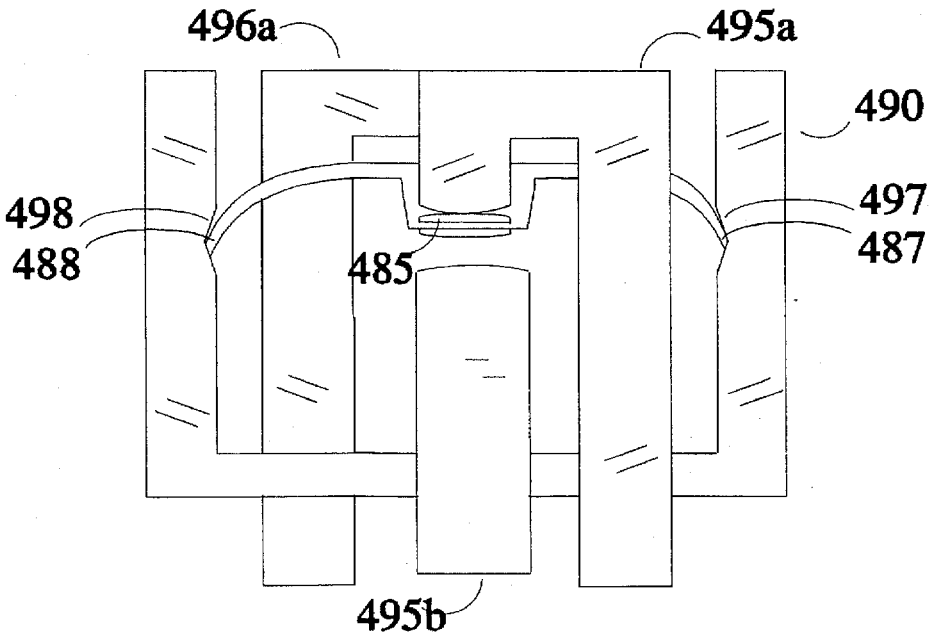

FIGS. 6A and 6B shown the spring 480 in a bowed upwards state. The spring 480 includes first and second edges 487 and 488 and wings 483 and 484 and has attached to it movable contacts 485 and 486. Housing 490, having recesses 498 and 497 for placing edges 488 and 487 of the spring 480, is shown in FIG. 6B. Those components are provided for the same reasons as for similarly numbered components of the spring 80, of FIG. 1A. The column member 482 and a center portion "Q" is also shown.

FIGS. 6A and 6B differ from FIGS. 2A and 2B in that fixed U-contacts 495*a* and 496*a* are provided. When the spring 480 is in a bowed upwards state as shown in FIGS. 6A and 6B, the fixed U-contacts 495*a* and 496*a* electrically contact the movable contacts 485 and 486, respectively. This allows current to pass from fixed U-contact 495*a* through the spring 480 and to the fixed U-contact 496*a*. Devices 496*b* and 495*b* shown in FIGS. 6A and 6B will be described with reference to FIGS. 7A and 7B.

Figure 7A:
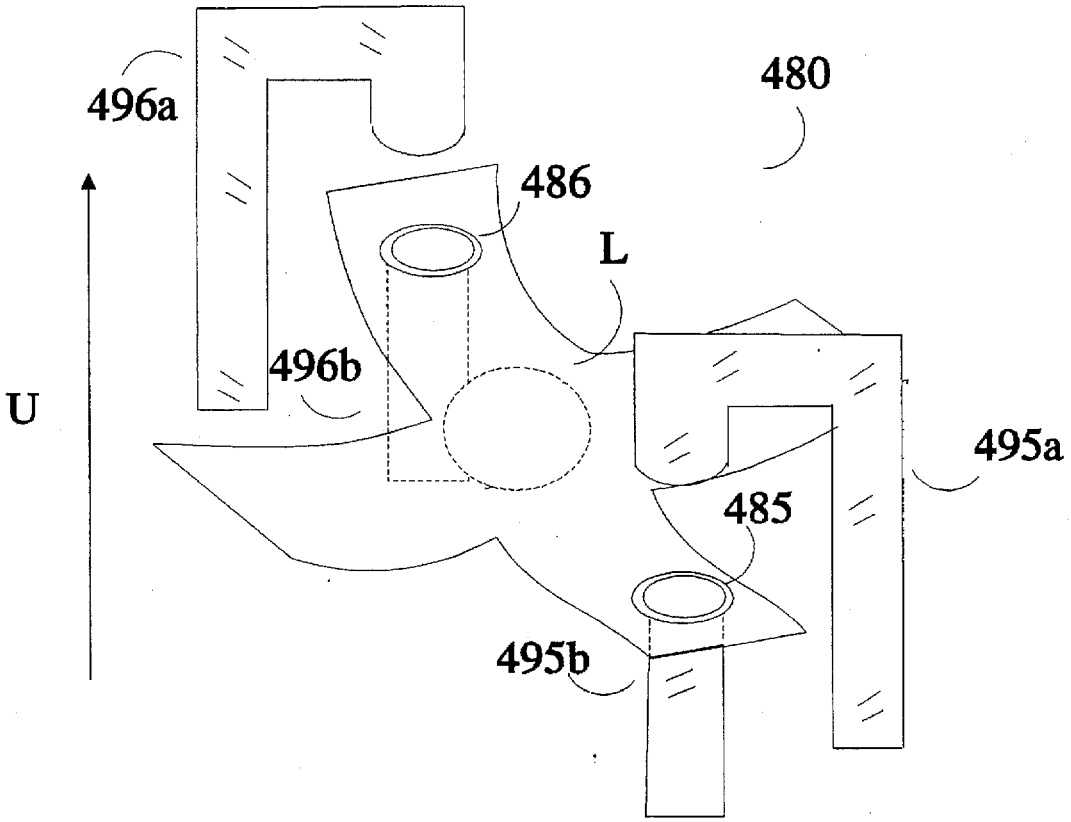
FIGS. 7A and 7B show perspective and cross sectional views of a spring which is open when it is bowed downwards.
Figure 7B:
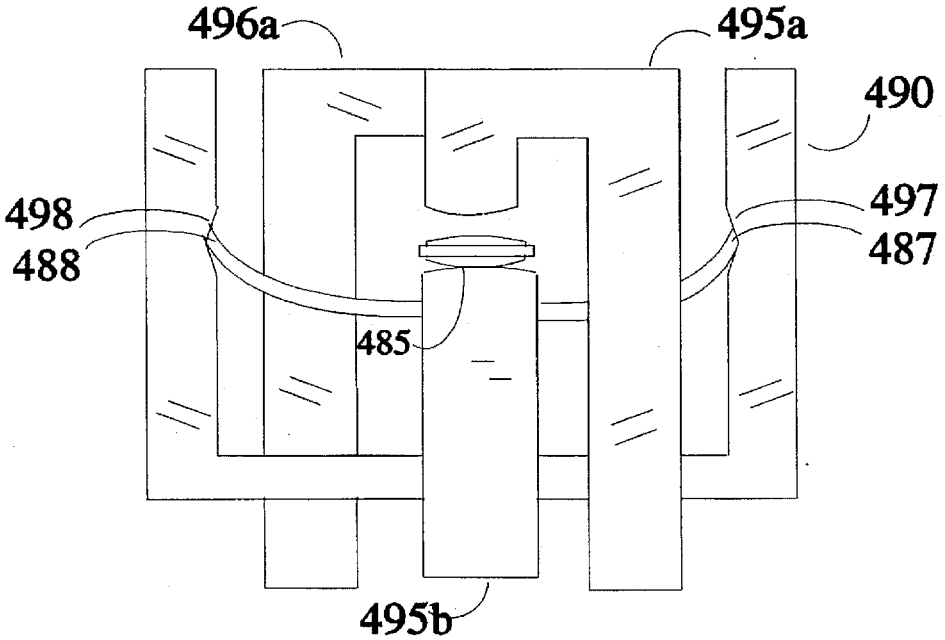

FIGS. 7A and 7B shown the spring 480 after an actuation force has been provided. The movable contacts 485 and 486 are no longer in electrical contact with the fixed U-contacts 495*a* and 496*a*, respectively. However the movable contacts 485 and 486 are in contact with the devices 495*b* and 496*b*. The devices 495*b* and 496*b* may be fixed contacts so that the spring 480 is electrically conductive in both its bowed upwards and bowed downwards state. The devices 495*b* and 496*b* may be springs such as wound springs, which provide a re-snap force after the actuation force is removed to return the spring 480 to its stable bowed upwards state. The devices 495*b* and 496*b* may be electrically inactive so that current does not pass through the spring 480 when it is in a bowed downwards state.

Figure 8A:
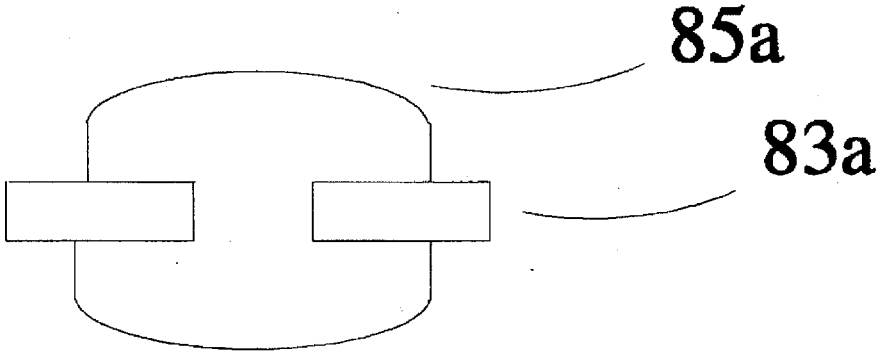
FIGS. 8A, 8B, and 8C show of alternative movable contact and wing embodiments.
Figure 8B:
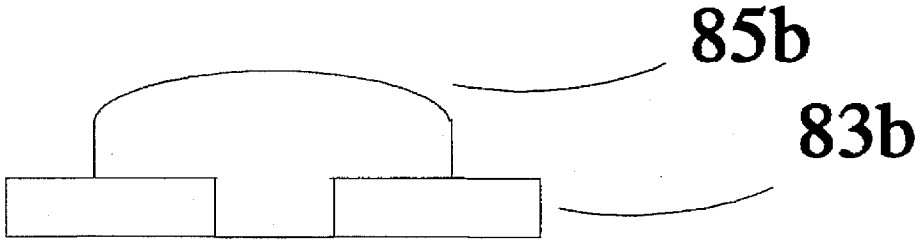
Figure 8C:
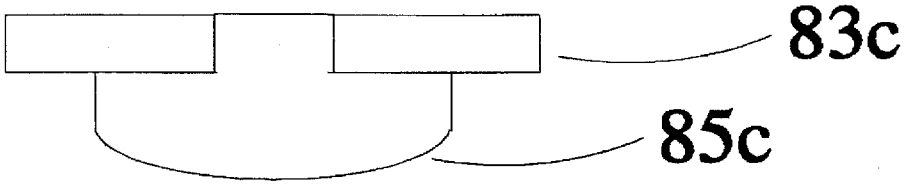

FIGS. 8A, 8B, and 8C show cross sectional views of alternatives providing a wing and movable contact for use with the present invention. FIG. 8A shown a two sided rounded movable contact 85*a* which is connected, such as by welding to wing 83*a*. Typically the wing 83*a* has a hole through it, through which the movable contact 85*a* is connected. FIGS. 8B and 8C shown movable contacts 85*b* and 85*c* and wings 83*b* and 83*c*, which are single sided contacts. Each type of contact connection may be more suitable for a particular application. Other manner of providing and connecting movable contacts are known to those skilled in the art.

Other embodiments not expressly disclosed herein would be readily apparent from this specification to those skilled in the art.

I claim:

1. A switching mechanism comprising:

a housing;

a spring comprising:

a first edge and a second edge, each edge substantially fixed to the housing, the spring substantially fixed to the housing only by the first edge and the second edge, the first and second edges substantially opposite one another, and a substantially central portion;

first and second movable contacts mechanically and electrically connected to the spring;

first and second substantially fixed contacts attached to the housing;

the first and second edges of the spring substantially fixed to the housing so that in a rest position the first movable contact does not contact the first substantially fixed contact and the second movable contact does not contact the second substantially fixed contact;

an actuator for providing an actuation force to force the substantially central portion of the spring towards a first direction;

wherein when the substantially central portion of the spring is forced towards the first direction the first and second movable contacts move in the first direction and come into electrical contact with the first and second substantially fixed contacts respectively;

wherein the spring is shaped substantially in the form of a cross comprising:

a column member having a first pair of opposing sides and a second pair of opposing sides, the first pair of opposing sides acting as the first and second edges of the spring, a first protruding wing attached substantially centrally to one side of the second pair of opposing sides of the column member, and a second protruding wing attached substantially centrally to the other side of the second pair of opposing sides of the column member;

the first movable contact mechanically and electrically attached to the first protruding wing; and the second movable contact mechanically and electrically attached to the second protruding wing.

2. The switching mechanism of claim 1 wherein the column member is flexed in a first bowed state in its rest position.

3. The switching mechanism of claim 2 wherein the spring is comprised of beryllium copper and the first and second movable contacts are each comprised of silver cadmium oxide.

4. The switching mechanism of claim 2 wherein the column member and the first and second protruding wings are integrated into a smooth cross shape.

5. The switching mechanism of claim 2 wherein the actuation force causes a flexing of the first and second protruding wings which provides a return force to return the spring to its rest position after the actuation force is removed.

6. The switching mechanism of claim 2 wherein the actuator comprises a ball.

7. The switching mechanism of claim 2 wherein the housing is comprised of a cylinder portion having an inner diameter;

the actuator is comprised of a substantially cylindrical portion having a first outer diameter, the substantially cylindrical portion having an elastic O-ring seal of a second outer diameter placed around it, the second outer diameter being greater than the first outer diameter, the actuator and the O-ring seal being placed in the cylinder portion of the housing, the second outer diameter of the elastic O-ring seal being about the size of the inner diameter of the cylinder portion of the housing, so that the O-ring seal rubs against the inner surface area of the cylinder portion of the housing when the actuator and the O-ring seal slide up and down.

8. The switching mechanism of claim 1 wherein the spring is comprised of beryllium copper and the first and second movable contacts are each comprised of silver cadmium oxide.

9. The switching mechanism of claim 1 wherein the column member and the first and second protruding wings are integrated into a smooth cross shape.

10. The switching mechanism of claim 1 wherein a return force is provided by the first and second substantially fixed contacts through the first and second movable contacts respectively to return the spring to its rest position after the actuation force is removed.

11. The switching mechanism of claim 3 wherein:

the housing is comprised of a cup shaped cylindrical portion having a solid surface at one end, and an inner surface area with an inner diameter, the inner surface area comprising a first recess and a second recess;

wherein the distance between the first and second edges of the column member is greater than the distance between the first and second recesses of the housing;

and wherein the column member is flexed into a bowed shape and the first and second edges of the column member are placed in the first and second recesses, respectively, of the housing.

12. The switching mechanism of claim 1 wherein the column member is substantially in the shape of a rectangle, having two short sides and two long sides, the first and second edges being the two short sides of the rectangle.

13. A switching mechanism comprising:

a housing;

a spring comprising:

a first edge and a second edge, each edge substantially fixed to the housing, the spring substantially fixed to the housing only by the first edge and the second edge, the first and second edges substantially opposite one another, and a substantially central portion;

a first movable contact mechanically and electrically connected to the spring;

a first substantially fixed contact attached to the housing;

the first and second edges of the spring substantially fixed to the housing so that in a rest position the first movable contact does not contact the first substantially fixed contact;

an actuator for providing an actuation force to force the substantially central portion of the spring towards a first direction;

wherein when the substantially central portion of the spring is forced towards the first direction the first movable contact moves in the first direction and comes into electrical contact with the first substantially fixed contact; and wherein the actuator comprises a ball.

14. The switching mechanism of claim 13 further comprising a member for sliding over the ball to force the ball downward to cause the actuation force to be applied.

15. The switching mechanism of claim 13 further comprising a member for forcing substantially directly downwards on the ball to force the ball downward to cause the actuation force to be applied.

16. The switching mechanism of claim 13 further comprising:

a second movable contact mechanically and electrically connected to the spring;

a second substantially fixed contact attached to the housing; and;

the first and second edges of the spring substantially fixed to the housing so that in the rest position the second movable contact does not contact the second substantially fixed contact;

wherein when the central portion of the spring is forced towards the first direction the second movable contact moves in the first direction and comes into electrical contact with the second substantially fixed contact.

17. The switching mechanism of claim 1 wherein the actuator comprises a ball.

18. A switching mechanism comprising:

a housing;

a spring comprising:

a first edge and a second edge, each edge substantially fixed to the housing, the spring substantially fixed to the housing only by the first edge and the second edge, the first and second edges substantially opposite one another, and a substantially central portion;

a first movable contact mechanically and electrically connected to the spring;

a first substantially fixed contact attached to the housing;

the first and second edges of the spring substantially fixed to the housing so that in a rest position the first movable contact does not contact the first substantially fixed contact;

an actuator for providing an actuation force to force the substantially central portion of the spring towards a first direction;

wherein when the substantially central portion of the spring is forced towards the first direction the first movable contact moves in the first direction and comes into electrical contact with the first substantially fixed contact; and wherein the housing is comprised of a cylinder portion having an inner diameter;

the actuator is comprised of a substantially cylindrical portion having a first outer diameter, the substantially cylindrical portion having an elastic O-ring seal of a second outer diameter placed around it, the second outer diameter being greater than the first outer diameter, the actuator and the O-ring seal being placed in the cylinder portion of the housing, the second outer diameter of the elastic O-ring seal being about the size of the inner diameter of the cylinder portion of the housing, so that the O-ring seal rubs against the inner surface area of the cylinder portion of the housing when the actuator and the O-ring seal slide up and down.

19. The switching mechanism of claim 18 and further comprising:

a second movable contact mechanically and electrically connected to the spring;

a second substantially fixed contact attached to the housing; and;

the first and second edges of the spring substantially fixed to the housing so that in the rest position the second movable contact does not contact the second substantially fixed contact;

wherein when the central portion of the spring is forced towards the first direction the second movable contact moves in the first direction and comes into electrical contact with the second substantially fixed contact.

20. The switching mechanism of claim 1 wherein the housing is comprised of a cylinder portion having an inner diameter;

the actuator is comprised of a substantially cylindrical portion having a first outer diameter, the substantially cylindrical portion having an elastic O-ring seal of a second outer diameter placed around it, the second outer diameter being greater than the first outer diameter, the actuator and the O-ring seal being placed in the cylinder portion of the housing, the second outer diameter of the elastic O-ring seal being about the size of the inner diameter of the cylinder portion of the housing, so that the O-ring seal rubs against the inner surface area of the cylinder portion of the housing when the actuator and the O-ring seal slide up and down.

21. A switching mechanism comprising:

a mechanism housing comprised of a hollow portion with an inner surface area and having an inner dimension;

an actuator comprised of an actuator housing which terminates in a free end, the actuator housing having an elastic seal placed around the actuator housing;

the actuator housing and the elastic seal being placed in the hollow portion of the mechanism housing;

the elastic seal having an outer dimension being approximately, equal to the inner dimension of the mechanism housing so that the elastic seal rubs against the inner surface area of the hollow portion of the mechanism housing when the actuator housing and the elastic seal slide up and down inside the mechanism housing;

a switching device responsive to the sliding of the actuator housing and the elastic seal in the hollow portion of the mechanism housing;

and wherein the actuator comprises a ball positioned at said free end, and wherein a section of the actuator housing which extends to said free end partially surrounds the ball and the ball partially extends outward from the section of the actuator housing, and the elastic seal is placed around the section of the actuator housing so that together the elastic seal and the section of the actuator housing have a substantially uniform outer dimension.

22. The switching mechanism of claim 21 and wherein:

the section of the actuator housing is comprised of a cylinder portion which has a first outer diameter;

the elastic seal is an O-ring seal having an outer dimension which is a second outer diameter;

and the first outer diameter and the second outer diameter are approximately equal.

23. A switching mechanism comprising:

a housing;

a spring comprising:

a first edge and a second edge substantially fixed to the housing, the spring substantially fixed to the housing only by the first edge and the second edge, the first and second edges substantially opposite one another, and a substantially central portion;

first and second movable contacts mechanically connected to the spring;

first and second substantially fixed contacts attached to the housing;

the first and second edges of the spring substantially fixed to the housing so that in a rest position the first and second movable contacts do not contact the first and second substantially fixed contacts, respectively;

an actuator for providing an actuation force to force the substantially central portion of the spring towards a first direction;

wherein when the substantially central portion of the spring is forced towards the first direction the first and second movable contacts move in the first direction and come into electrical contact with the first and second substantially fixed contacts, respectively;

and wherein a return force is provided by the first and second substantially fixed contacts through the first and second movable contacts, respectively, to return the spring to its rest position after the actuation force is removed; and wherein the spring is shaped substantially in the form of a cross comprising:

a column member having a first pair of opposing sides and a second pair of opposing sides, the first pair of opposing sides acting as the first and second edges of the spring, a first protruding wing attached substantially centrally to one side of the second pair of opposing sides of the column member, and a second protruding wing attached substantially centrally to the other side of the second pair of opposing sides of the column member, the first movable contact mechanically connected to the first protruding wing; and the second movable contact mechanically connected to the second protruding wing.

24. The switching mechanism of claim 23 wherein the column member is flexed in a first bowed state in its rest position.

25. A switching mechanism comprising:

a housing;

a spring comprising:

a first edge and a second edge, each edge substantially fixed to the housing, the first and second edges substantially opposite one another, and a substantially central portion;

a column member having a first pair of opposing sides and a second pair of opposing sides, the first pair of opposing sides acting as the first and second edges of the spring, wherein the column member is substantially in the shape of a rectangle, having two short sides and two long sides, the first and second edges being the two short sides of the rectangle, and a first protruding wing attached substantially centrally and substantially perpendicularly to one side of the second pair of opposing sides of the column member;

a first movable contact mechanically and electrically connected to the spring and positioned on the first protruding wing;

a first substantially fixed contact attached to the housing;

the first and second edges of the spring substantially fixed to the housing so that in a rest position the first movable contact does not contact the first substantially fixed contact;

an actuator for providing an actuation force to force the substantially central portion of the spring towards a first direction; and wherein when the substantially central portion of the spring is forced towards the first direction the first movable contact moves in the first direction and comes into electrical contact with the first substantially fixed contact.

26. The switching mechanism of claim 25 wherein:

the spring further comprises:

a second protruding wing attached substantially centrally and substantially perpendicularly to the side of the second pair of opposing sides of the column member opposite from the first protruding wing;

a second movable contact mechanically and electrically connected to the spring and positioned on the second protruding wing;

a second substantially fixed contact attached to the housing; and;

the first and second edges of the spring substantially fixed to the housing so that in the rest position the second movable contact does not contact the second substantially fixed contact; and wherein when the central portion of the spring is forced towards the first direction the second movable contact moves in the first direction and comes into electrical contact with the second substantially fixed contact.

27. A switching mechanism comprising:

a housing;

a spring comprising:

a first edge and a second edge, each edge substantially fixed to the housing, the first and second edges substantially opposite one another, and a substantially central portion;

a first movable contact mechanically and electrically connected to the spring;

a first substantially fixed contact attached to the housing;

the first and second edges of the spring substantially fixed to the housing so that in a rest position the first movable contact does not contact the first substantially fixed contact;

an actuator for providing an actuation force to force the substantially central portion of the spring towards a first direction;

wherein when the substantially central portion of the spring is forced towards the first direction the first movable contact moves in the first direction and comes into electrical contact with the first substantially fixed contact; and wherein the actuator comprises a ball.

28. The switching mechanism of claim 27 wherein:

the housing comprises:

a cylinder portion having an inner diameter;

the actuator comprises:

a substantially cylindrical portion having a first outer diameter, the substantially cylindrical portion having an elastic O-ring seal of a second outer diameter placed around it, the second outer diameter being greater than the first outer diameter, the actuator and the O-ring seal being placed in the cylinder portion of the housing, the second outer diameter of the elastic O-ring seal being about the size of the inner diameter of the cylinder portion of the housing, so that the O-ring seal rubs against the inner surface area of the cylinder portion of the housing when the actuator and the O-ring seal slide up and down.

29. A switching mechanism comprising:

a housing;

a spring comprising:

a first edge and a second edge, each edge substantially fixed to the housing, the first and second edges substantially opposite one another, and a substantially central portion;

a first movable contact mechanically and electrically connected to the spring;

a first substantially fixed contact attached to the housing;

the first and second edges of the spring substantially fixed to the housing so that in a rest position the first movable contact does contact the first substantially fixed contact;

an actuator for providing an actuation force to force the substantially central portion of the spring towards a first direction; and wherein when the substantially central portion of the spring is forced towards the first direction the first movable contact moves in the first direction and releases from electrical contact with the first substantially fixed contact.

30. The switching mechanism of claim 29 and wherein the actuator comprises a ball.

31. The switching mechanism of claim 29 further comprising:

a column member having a first pair of opposing sides and a second pair of opposing sides, the first pair of opposing sides acting as the first and second edges of the spring, wherein the column member is substantially in the shape of a rectangle, having two short sides and two long sides, the first and second edges being the two short sides of the rectangle, and a first protruding wing attached substantially centrally and substantially perpendicularly to one side of the second pair of opposing sides of the column member and wherein the first movable contact is positioned on the first protruding wing.

32. The switching mechanism of claim 29 wherein the spring is substantially fixed to the housing only by the first edge and the second edge.

33. The switching mechanism of claim 32 further comprising:

a second movable contact mechanically and electrically connected to the spring;

a second substantially fixed contact attached to the housing; and;

the first and second edges of the spring substantially fixed to the housing so that in the rest position the second movable contact does contact the second substantially fixed contact;

wherein when the central portion of the spring is forced towards the first direction the second movable contact moves in the first direction and releases from electrical contact with the second substantially fixed contact;

and wherein the spring is shaped substantially in the form of a cross comprising:

a column member having a first pair of opposing sides and a second pair of opposing sides, the first pair of opposing sides acting as the first and second edges of the spring, a first protruding wing attached substantially centrally to one side of the second pair of opposing sides of the column member, and a second protruding wing attached substantially centrally to the other side of the second pair of opposing sides of the column member;

the first movable contact mechanically and electrically attached to the first protruding wing; and the second movable contact mechanically and electrically attached to the second protruding wing.

34. The switching mechanism of claim 32 wherein the actuator comprises a ball.

35. The switching mechanism of claim 32 wherein the housing is comprised of a cylinder portion having an inner diameter;

the actuator is comprised of a substantially cylindrical portion having a first outer diameter, the substantially cylindrical portion having an elastic O-ring seal of a second outer diameter placed around it, the second outer diameter being greater than the first outer diameter, the actuator and the O-ring seal being placed in the cylinder portion of the housing, the second outer diameter of the elastic O-ring seal being about the size of the inner diameter of the cylinder portion of the housing, so that the O-ring seal rubs against the inner surface area of the cylinder portion of the housing when the actuator and the O-ring seal slide up and down.

36. A switching mechanism comprising:

a housing;

a spring comprising:

a first edge and a second edge substantially fixed to the housing, the first and second edges substantially opposite one another, and a substantially central portion;

first and second movable contacts mechanically connected to the spring;

first and second substantially fixed contacts attached to the housing;

the first and second edges of the spring substantially fixed to the housing so that in a rest position the first and second movable contacts do contact the first and second substantially fixed contacts, respectively;

an actuator for providing an actuation force to force the substantially central portion of the spring towards a first direction;

wherein when the substantially central portion of the spring is forced towards the first direction the first and second movable contacts move in the first direction and release from electrical contact with the first and second substantially fixed contacts, respectively;

and wherein a return force is provided by the first and second substantially fixed contacts through the first and second movable contacts, respectively, to return the spring to its rest position after the actuation force is removed; and wherein the spring is shaped substantially in the form of a cross comprising:

a column member having a first pair of .opposing sides and a second pair of opposing sides, the first pair of opposing sides acting as the first and second edges of the spring, a first protruding wing attached substantially centrally to one side of the second pair of opposing sides of the column member, and a second protruding wing attached substantially centrally to the other side of the second pair of opposing sides of the column member, the first movable contact mechanically connected to the first protruding wing; and the second movable contact mechanically connected to the second protruding wing.

37. The switching mechanism of claim 36 wherein the spring is substantially fixed to the housing only by the first edge and the second edge.

* * * * *